US006637311B2

(12) United States Patent
Barden

(10) Patent No.: US 6,637,311 B2
(45) Date of Patent: Oct. 28, 2003

(54) SENSORY FEEDBACK SYSTEM FOR AN ELECTRO-HYDRAULICALLY CONTROLLED SYSTEM

(75) Inventor: William M. Barden, Raleigh, NC (US)

(73) Assignee: Caterpillar Inc, Peoria, IL (US)

( * ) Notice: Subject to any disclaimer, the term of this patent is extended or adjusted under 35 U.S.C. 154(b) by 17 days.

(21) Appl. No.: 10/038,668

(22) Filed: Jan. 8, 2002

(65) Prior Publication Data

US 2003/0126980 A1 Jul. 10, 2003

(51) Int. Cl.[7] ..... F15B 13/14
(52) U.S. Cl. ..... 91/434; 74/471 XY
(58) Field of Search ..... 91/434, 370; 74/471 XY; 324/207.22, 207.24; 335/229

(56) References Cited

U.S. PATENT DOCUMENTS

| | | | | |
|---|---|---|---|---|
| 4,392,543 A | | 7/1983 | Buckhouse et al. | |
| 5,396,266 A | * | 3/1995 | Brimhall | 74/471 XY |
| 5,721,566 A | | 2/1998 | Rosenberg et al. | 74/471 XY |
| 5,735,490 A | | 4/1998 | Berthet et al. | |
| 5,809,841 A | | 9/1998 | Smith | |
| 5,953,196 A | | 9/1999 | Zimmermann | |
| 5,969,520 A | | 10/1999 | Schottler | 74/471 XY |
| 5,979,268 A | | 11/1999 | Freberg et al. | |
| H1850 H | | 6/2000 | Zimmermann | 74/471 XY |
| 6,098,481 A | | 8/2000 | Mills et al. | 74/471 XY |
| 6,166,723 A | | 12/2000 | Schena et al. | |

FOREIGN PATENT DOCUMENTS

| | | |
|---|---|---|
| EP | 0483773 A1 | 5/1992 |
| GB | 2114717 A | 8/1983 |
| GB | 2308880 A | 7/1997 |
| WO | WO 88/06242 | 8/1988 |

* cited by examiner

*Primary Examiner*—Edward K. Look
*Assistant Examiner*—Thomas E. Lazo
(74) *Attorney, Agent, or Firm*—Finnegan, Henderson, Farabow, Garrett & Dunner

(57) ABSTRACT

An apparatus for providing feedback to an operator relative to a force applied to a system is disclosed. The apparatus has a first magnet and a second magnet. The first magnet receives a signal indicative of the force applied to the system and generates a first magnetic field in response to the signal. The second magnet is disposed adjacent the first magnet and generates a second magnetic field that interacts with the first magnetic field to generate a magnetic force. An operator interface is operatively engaged with one of the first magnet and the second magnet such that the magnetic force acts on the operator interface.

21 Claims, 2 Drawing Sheets

SENSORY FEEDBACK SYSTEM FOR AN ELECTRO-HYDRAULICALLY CONTROLLED SYSTEM

TECHNICAL FIELD

This invention relates generally to a feedback system for an electro-hydraulically controlled system. More particularly, the invention relates to a system that provides an operator with sensory feedback corresponding to a force applied to an electro-hydraulically controlled system.

BACKGROUND

Work machines, such as, for example, wheel loaders, track loaders, backhoes, excavators, and bulldozers, often use hydraulic systems to power a work implement to perform work. These work machines also typically include an operator interface, such as, for example, a control lever or joystick, that an operator may manipulate to control the movement of the work implement. During operation of the work machine, the operator may desire feedback from the work machine regarding the magnitude of the force required by the work implement to perform a particular work task. Given this feedback, the operator may modify the work being performed by the work implement to more efficiently perform the work task. For example, if the work machine is excavating material from a work site and the feedback indicates that the work machine is having to exert a great force to lift the material, the operator may alter the motion of the work implement to excavate less material or to adjust the position of the work implement to avoid an impediment, which may be a large rock or other obstacle.

The work machine may include a feedback system to provide the operator with information regarding the amount of work being performed by the work implement. The feedback may include an indication of how much force the hydraulic system is exerting to move the work implement. The feedback system may present the feedback to the operator in a variety of forms.

The recent trend in work machine control systems is towards electronic control systems that provide the operator with a better control of the machine. These electronic control systems may be operated, for example, by turning on a switch or by touching a keypad. However, these electronic control systems are not typically capable of providing a tactile feedback to the operator. When operating the electronic controls, the operator must determine the force exerted on the hydraulic system through other means, such as, for example, closely observing the response time of the work implement.

One feedback system is described in U.S. Statutory Invention Registration H1,850, issued Jun. 6, 2000, to Daniel E. Zimmerman. In this system, a cable is wound around the pivotal position of a joystick. Both ends of the cable are attached to plungers that are pulled toward each other when an electrical current is applied to a solenoid. This system, however, is intended to center the joystick and does not provide an operator with a tactile sense (or "feel") that is indicative of the work done being performed by the work machine.

The present invention is directed to solving one or more of the problems set forth above.

SUMMARY OF THE INVENTION

One aspect of the present invention is directed to an apparatus for providing feedback to an operator relative to a force applied to a system. The apparatus includes a first magnet configured to receive a signal indicative of the force applied to the system and to generate a first magnetic field in response to the signal. A second magnet is disposed adjacent the first magnet and is configured to generate a second magnetic field that interacts with the first magnetic field to generate a magnetic force. An operator interface is operatively engaged with one of the first magnet and the second magnet such that the magnetic force acts on the operator interface.

Another aspect of the invention is a method of controlling a hydraulic actuator having a first chamber and a second chamber. An operator interface is operated to generate a flow of pressurized fluid to at least one of the first and second chambers. A pressure representative of the pressure of the fluid in at least one of the first and second chambers is sensed. A signal based on the sensed pressure is generated. The signal is transmitted to at least one of a first and second magnets to generate a magnetic force that acts on the operator interface.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments of the invention and together with the description, serve to explain the principles of the invention. In the drawings.

DETAILED DESCRIPTION

A work machine, such as, for example, a wheel loader, a track loader, a bulldozer, an excavator, or any other earth moving machine, may include an operator interface. The operator interface may be configured to control the movement of the work machine, as well as to control the movement of a work implement that is mounted on the work machine. By manipulating the operator interface, an operator may control the operation of the work machine.

Figure 1:
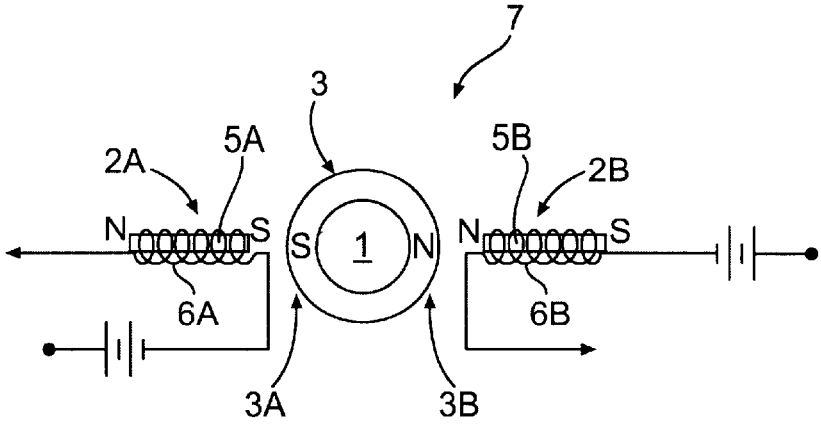
FIG. 1 is a schematic illustration of an apparatus for providing sensory feedback to an operator in accordance with an exemplary embodiment of the present invention.
Figure 2:
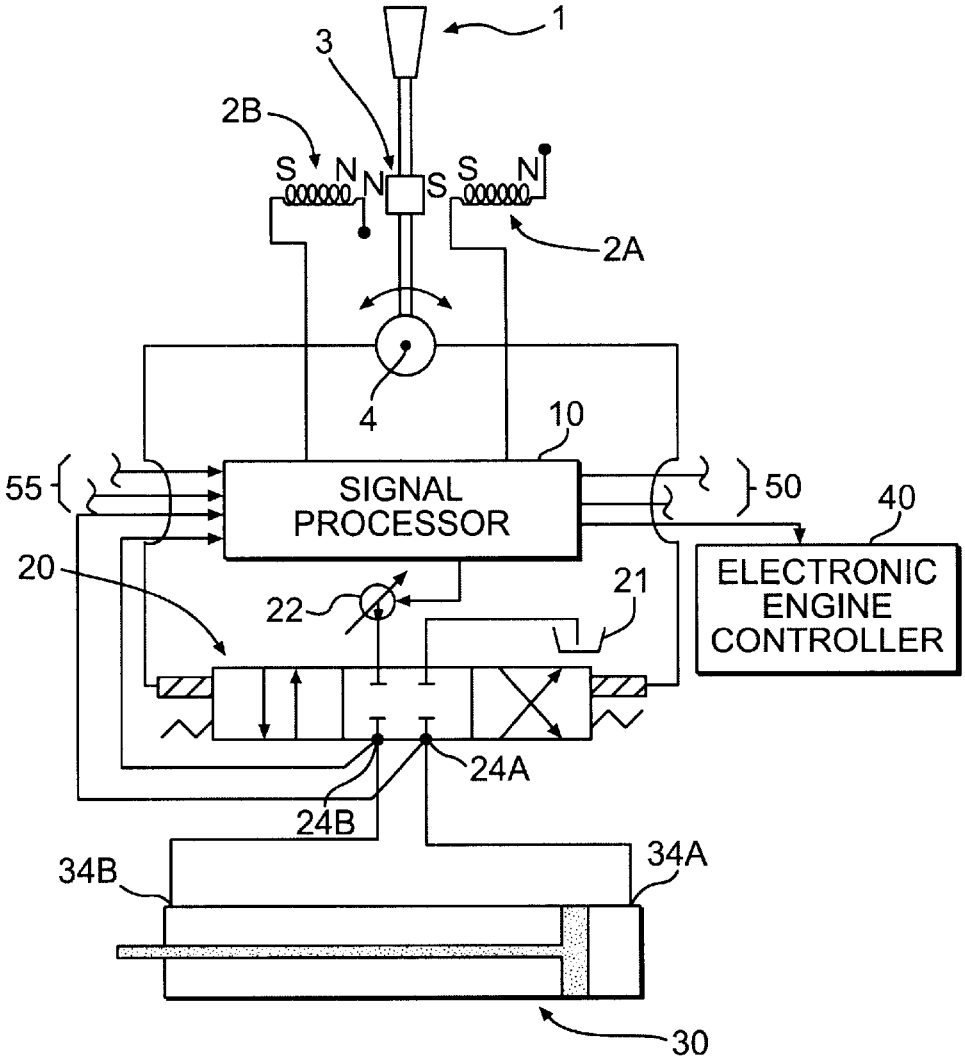
FIG. 2 is a schematic illustration of an electro-hydraulic control system in accordance with an exemplary embodiment of the present invention.

As illustrated in the exemplary embodiments of FIGS. 1 and 2, the operator interface may be a control lever 1. The operator interface may also be any other device commonly used to control the movements of a work machine, such as, for example, a joystick. In addition, operator interface may be any other device commonly used to control a system that performs a measurable function, such as, for example, a video game.

As illustrated in FIG. 1, a feedback system 7 may be operatively engaged with control lever 1. Feedback system 7 may include a magnet 3 that is fixed to control lever 1. Magnet 3 may generate a magnetic field that includes a south pole 3A and a north pole 3B. While magnet 3 is illustrated as a ring magnet, it should be understood that magnet 3 may be any another type of magnet, such as, for example, a bar magnet or disk magnet.

Feedback system 7 may further include a first electromagnet 2A and a second electromagnet 2B. Each of first and second electromagnets 2A and 2B includes an electric coil 6A and 6B, respectively, that is wrapped around a corresponding armature 5A and 5B, respectively. When a current is applied to electric coil 6A, a magnetic field may be generated around armature 5A.

Similarly, when a current is applied to electric coil 6B, a magnetic field may be generated around armature 5B.

The magnetic field generated by each electromagnet 2A and 2B will include a south pole and a north pole. The location of each pole in the particular magnetic field is dependent upon the direction of the applied current. The density and strength of the magnetic field may be adjusted by altering the magnitude of the applied current and/or by altering the number of coils in each electric coil 6A and 6B.

As illustrated in FIG. 1, first and second electromagnets 2A and 2B may be disposed on opposite sides of magnet 3 so that the magnetic fields generated by first and second electromagnets 2A and 2B interact with the magnetic field generated by magnet 3 to create a magnetic force. In the illustrated example, the south pole of first electromagnet 2A aligns with south pole 3A of magnet 3, and the north pole of second electromagnet 2B aligns with north pole 3B of magnet 3. This arrangement may generate a repulsive, or "bucking," magnetic force between each of first and second electromagnets 2A and 2B and magnet 3. First and second electromagnets 2A and 2B may be positioned relative to magnet 3 to maximize the density of magnetic flux in the generated magnetic fields.

Alternatively, the magnets may be arranged to generate attractive magnetic forces. For example, the south pole of first electromagnet 2A may be aligned with north pole 3B of magnet 3, and the north pole of second electromagnet 2B may be aligned with south pole 3A of magnet 3. This arrangement may generate an attractive magnetic force between each of first and second electromagnets 2A and 2B and magnet 3.

In addition, the magnets may be arranged to generate a combination of attractive and repulsive magnetic forces. For example, the south pole of first electromagnet 2A may be aligned with north pole 3B of magnet 3, and the south pole of second electromagnet 2B may be aligned with south pole 3A of magnet 3. This arrangement may generate an attractive magnetic force between the first electromagnet 2A and magnet 3 and a repulsive force between second electromagnet 2B and magnet 3.

The magnets may further be configured to allow for a change in polarity. For example, a switch or other device (not shown) may be connected to electric coil 6A. By operating the switch, the current applied to first electromagnet 2A may be reversed. This may result in a reversal of the polarity of first electromagnet 2A. In other words, operation of the switch may result in the north pole of first electromagnet 2A being adjacent south pole 3A of magnet 3, instead of south pole of first electromagnet 2A being adjacent south pole 3A of magnet 3. Thus, by operating the switch the magnetic force generated by the interaction of the magnetic fields may be switched between an attractive force and a repulsive force.

Although the exemplary embodiment shown in FIG. 1 depicts a particular magnet arrangement, it should be understood that the magnets may be placed in any arrangement that will allow a magnetic force to be exerted on the operator interface. For example, first and second electromagnets 2A and 2B may be positioned in parallel with respect to magnet 3. Alternatively, a plurality of electromagnets may be positioned around magnet 3 on the operator interface. One skilled in the art will appreciate that other arrangements are also possible.

As illustrated in FIG. 2, control lever 1 may be operated to control the rate and direction of fluid flow between a source of pressurized fluid, such as a pump 22, a tank 21, and a first and second chamber of a hydraulic actuator. In the exemplary embodiment illustrated in FIG. 2, the hydraulic actuator is illustrated as a hydraulic cylinder 30 with a head end 34A and a rod end 34B. It should be understood, however, that the hydraulic actuator may be any other type of force generating device commonly used in hydraulic systems, such as, for example, a fluid motor.

Control lever 1 is operable to control the rate and direction of fluid flow into and out of head end 34A and rod end 34B by governing the position of a directional control valve. In the exemplary embodiment illustrated in FIG. 2, the directional control valve is a spool valve 20. It should be understood that the directional control valve may also be another suitable device, such as, for example, a set of independent metering valves.

The position of spool valve 20 governs the movement of hydraulic actuator 30. Spool valve 20 may be selectively moved between a first position where head end 34A of hydraulic cylinder 30 is connected to pump 22 and rod end 34B is connected to tank 21, and a second position where head end 34A is connected to tank 21 and rod end 34B is connected to pump 22. When spool valve 20 is in the first position, pressurized fluid may flow from pump 22 to head end 34A and fluid may also flow from rod end 34B to tank 21. The pressure of the fluid entering head end 34A exerts a force on a piston disposed in hydraulic cylinder 30. The force causes the piston to move in a first direction. When spool valve 20 is in the second position, pressurized fluid may flow from pump 22 to rod end 34B and fluid may flow from head end 34A to tank 21. The force causes the piston to move in a second direction. Thus, the pressure of the fluid in head end 34A and rod end 34B is directly related to the force exerted by hydraulic cylinder 30.

As shown in FIG. 2, control lever 1 may be configured to pivot around a pivot point 4. Movement of control lever 1 in a first direction may cause spool valve 20 to move towards the first position to thereby cause hydraulic cylinder 30 to move in a first direction. Similarly, movement of the control lever 1 in a second direction may cause spool valve 20 to move towards the second position to thereby cause hydraulic cylinder 30 to move in a second direction. Thus, control lever 1 may be used to control the movement of hydraulic cylinder 30.

As shown in FIG. 2, a first pressure sensor 24A may be configured to sense the pressure of the fluid in head end 34A of hydraulic cylinder 30. A second pressure sensor 24B may be configured to sense the pressure of the fluid in rod end 34B of hydraulic cylinder 30. First and second pressure sensors 24A, 24B may be disposed at any point in the system where the sensor may sense a pressure indicative of the fluid pressure in the respective end of hydraulic cylinder 30. First and second pressure sensors 24A and 24B may be any device capable of sensing a fluid pressure, such as, for example, pressure transducers.

As also shown in FIG. 2, a signal processor 10 is configured to receive input from first and second pressure sensors 24A and 24B regarding the fluid pressure in the respective end of hydraulic cylinder 30. Based on this information, signal processor 10 determines an appropriate feedback signal to transmit to first and second electromagnets 2A and 2B to provide feedback to the operator. The feedback signal is indicative of the force being exerted by hydraulic cylinder 30 on the work implement and is, therefore, also indicative of the force being exerted on the work implement by external elements.

The feedback signal may be transmitted to at least one of first and second electromagnets 2A and 2B to provide tactile feedback to an operator. The energization of one of first and second electromagnets 2A and 2B may create a magnetic field that interacts with the magnetic field of magnet 3 to generate a magnetic force. The generated magnetic force may act on control lever 1 to oppose movement of control lever 1. For example, when an operator is moving control lever 1 in a first direction to generate a movement of hydraulic cylinder 30 in a first direction, signal processor will monitor the pressure of the fluid in head and rod ends 34A and 34B. Based on the monitored pressures, signal processor 10 will energize at least one of first and second electromagnets 2A and 2B to thereby generate a magnetic force that opposes movement of control lever 1 in the first direction. The operator will experience this force as a resistance to further movement of control lever 1. In this manner, feedback system 7 may provide the operator with a tactile sense of the work being performed by hydraulic cylinder 30.

The magnitude of the generated magnetic force exerted on the operator interface may depend upon the magnitude of the force exerted on the hydraulic actuator. For example, the magnitude of the magnetic force acting on control lever 1 may vary in direct proportion to the magnitude of the force exerted by or on hydraulic cylinder 30. It should be understood that the magnitude of the generated magnetic force that acts on control lever 1 may be related to the magnitude of the force exerted by or on hydraulic cylinder 30 in any other way readily apparent to one skilled in the art.

The feedback signal generated by signal processor 10 acts to control the magnitude of the magnetic force acting on control lever 1. The feedback signal, which may be, for example, a current or a pulse width modulation type signal, may result in varying energization levels of first and second electromagnets 2A and 2B. For example, if the feedback signal is an electrical current, the magnitude of the current will determine the strength of the generated magnetic field and, therefore, the magnitude of the resulting magnetic force. Thus, by varying the magnitude of the current, the force exerted on control lever 1 may be similarly controlled.

Moreover, signal processor 10, upon receipt of the input from pressure sensors 24A and 24B or any other signals representing various operating parameters 55 of the system, may send signals 50 to an electronic engine controller 40 or another controlling system to perform additional functions in the system. For example, the input processor 10 may send signals to the electronic engine controller 40 to adjust the electronically controlled hydraulic pump 22 to control the generation rate of pressurized fluid.

One skilled in the art will appreciate that magnet 3 may be an electromagnet and that first and second electromagnets 2A and 2B may be permanent magnets. If magnet 3 is an electromagnet, signal processor 10 may be configured to transmit a feedback signal to energize magnet 3. This feedback signal may also be indicative of the work being done by the system or machine and may result in an interacting magnetic force being exerted on an operator interface to provide sensory feedback to the operator.

Figure 3:
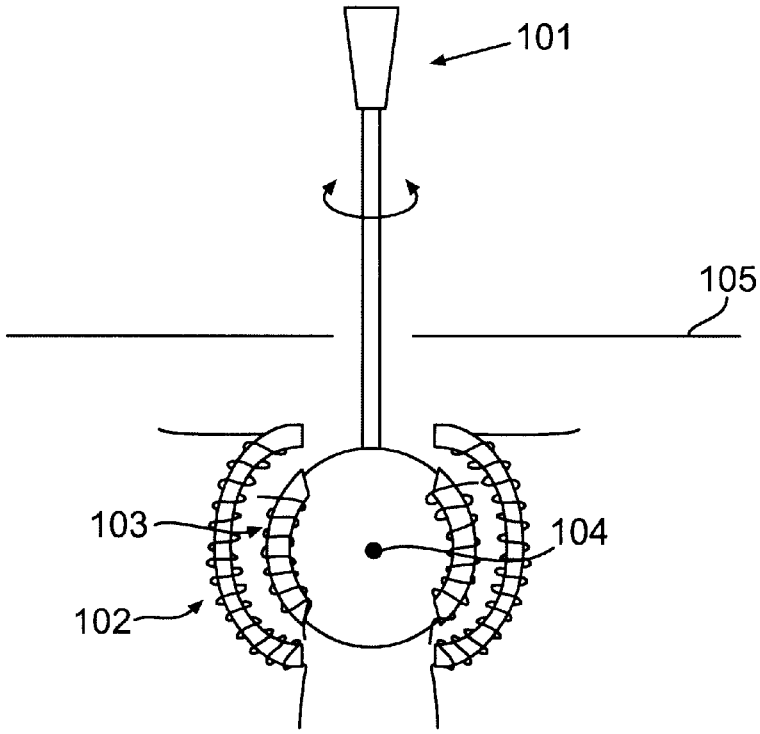
FIG. 3 is a schematic illustration of an apparatus for providing sensory feedback to an operator in accordance with another exemplary embodiment of the present invention.

FIG. 3 illustrates another exemplary arrangement of a sensory feedback apparatus. As shown, the operator interface may be a wobble joystick 101 that is configured to pivot around a pivot point 104 . Pivot point 104 may be positioned below a surface 105, which may be, for example, a console panel in the cab of the work machine. Wobble joystick 101 may be manipulated to control one or more operating functions of the work machine. For example, wobble joystick 101 may be configured to control both the crowd and swing functions of an excavator.

As illustrated in FIG. 3, a first magnet 102 may be positioned around the pivot 104 in a fixed position relative to surface 105. A second magnet 103 may be mounted on wobble joystick 101 adjacent to the first magnet 102. First and second magnets 102 and 103 may be electromagnets that are energized by the application of a current. Alternatively, one of first and second magnets 102 and 103 may be a permanent magnet.

First and second magnets 102 and 103 are disposed adjacent each other so that a feedback signal may be applied to the first and second magnets 102 and 103 to generate interacting magnetic fields that create a magnetic force that acts on wobble joystick 101. First and second magnets 102 and 103 may be arranged to generate a repulsive, or bucking, magnetic force. Alternatively, first and second magnets 102 and 103 may be arranged to generate an attractive magnetic force.

As described previously, signal processor 201 may vary the feedback signal in accordance with the force exerted by a hydraulic actuator. Varying the feedback signal may vary the magnetic force exerted on wobble joystick 101 to thereby enable an operator of a system or machine to "feel" the work being done by the system or machine. First and second magnets 102 and 103 may be arranged to achieve a maximum density of magnetic flux between the generated magnetic fields.

It should be understood that the interacting magnetic fields generated by magnets 102 and 103 may also be used as a detent mechanism to hold the wobble joystick 101 stationary in one or more positions relative to the surface 105. For example, when the operator moves wobble joystick 101 to a position typically associated with a certain machine function, such as, for example, a "return to dig" function, the magnetic fields generated by magnets 102 and 103 may be adjusted to create a magnetic force that holds wobble joystick 101 in the desired position. The magnetic fields may be adjusted, for example, by changing the polarity of magnets 102 and 103 or by de-energizing one magnet and energizing the other magnet. When the machine function is complete or when the function is overridden by an operator or linkage input, the magnetic fields generated by magnets 102 and 103 may be re-adjusted to create a magnetic force that will return wobble joystick 101 to its original position.

Feedback system 7 may determine the position of control lever 1 through any process readily apparent to one skilled in the art. For example, a position sensor may be operatively engaged with control lever 1. In addition, feedback system 7 may include a device configured to sense the magnetic flux generated by the interacting magnetic fields. The magnitude of the magnetic flux may be used to determine the position of control lever 1.

Feedback system 7 may be used to provide an operator with tactile feedback regarding the forces exerted on multiple hydraulic actuators on the work machine. Consider, for example, an excavator that includes a first hydraulic actuator to control a "swing" movement of the excavator and a second hydraulic actuator to control a "crowd" movement. Wobble joystick 101 may be configured to control both the swing and crowd movement. Each of the swing and crowd hydraulic actuators may experience a different magnitude of force during standard operation of the excavator.

Figure 4:
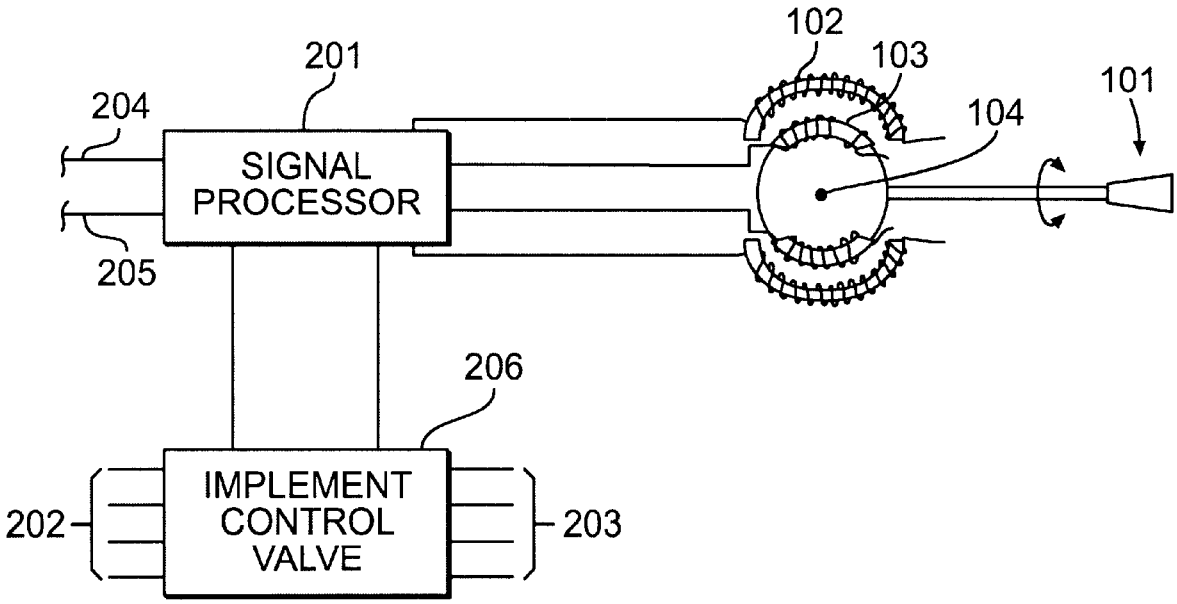
FIG. 4 is a schematic of an electro-hydraulic control system in accordance with another exemplary embodiment of the present invention.

As illustrated in FIG. 4, signal processor 201 may be connected to a first implement control valve 206 and to additional implement control valves (not shown) through transducer busses 204 and 205. In the excavator example, implement control valve 206 may be used control the hydraulic actuator that governs the "swing" motion of the excavator and the additional implement control valves may be used to control the hydraulic actuators that govern the "crowd" motion of the excavator. Signal processor 201 receives pressure information from each of the implement control valves that indicates the magnitude of force being exerted on both the swing and crowd hydraulic actuators. Signal processor 201 may generate multiple feedback signals to provide feedback for each of the swing and crowd functions.

Signal processor 201 may transmit, for example, a "swing" feedback signal to a first set of magnets and a "crowd" feedback signal to a second set of magnets. Each of the first and second sets of magnets may be configured to generate magnetic forces that act to oppose movement of wobble joystick 101 in different directions. For example, the swing feedback signal may energize the first set of magnets to generate a magnetic force that opposes movement of wobble joystick 101 in the swing direction. The crowd feedback signal may energize the second set of magnets to generate a magnetic force that opposes movement of wobble joystick 101 in the crowd direction. Thus, tactile feedback may be provided to an operator through an operator interface that controls movement of a work implement in multiple directions.

IINDUSTRIAL APPLICABILITY

The disclosed invention is useful, for example, in providing sensory feedback to the operator of a machine or system that performs work. The feedback system is configured to exert a magnetic force on an operator interface that corresponds to the force exerted by a hydraulic actuator. The feedback delivered to the operator through the operator interface is based on the pressure of the fluid within the hydraulic actuator and may be varied based on the magnitude of the pressure of the fluid within the hydraulic actuator.

For illustration purposes, consider three types of soil conditions that the work implement may encounter: smooth and sandy soil, clay-like soil, and large rocks. If the soil is smooth and sandy, less force is required of hydraulic cylinder 30 to move the work implement and, thus, less pressure is experienced by the pressure sensors 24A and 24B. On the other hand, if the soil is clay-like, a greater force is exerted and a greater pressure is experienced by the pressure sensors 24A and 24B. Further, if the work implement engages a large rock that prevents further movement of the work implement, a maximum pressure may be experienced by hydraulic cylinder 30 and sensed by pressure sensors 24A and 24B. The pressure sensors 24A and 24B then generate signals that indicate the magnitude of the fluid pressure within hydraulic cylinder 30 and transmit the signals to signal processor 10.

Signal processor 10, upon receipt of the pressure information, may generate a feedback signal having a current (or any other applicable signal) that may be adjusted in proportion to the sensed pressures. The feedback signal may be transmitted to at least one of first and second electromagnets 2A and 2B to thereby generate a magnetic force that acts on control lever 1. Signal processor 10 may be configured such that the feedback signal may be varied between a minimum feedback level and a maximum feedback level. The minimum feedback level may correspond to a minimum threshold force that may be exerted on hydraulic cylinder 30 before a feedback signal will be initiated. The maximum feedback level may correspond to a maximum force that may be exerted on hydraulic cylinder 30, such as when the work implement has struck an immoveable object.

The feedback signal is then transmitted to at least one of electric coils 6A and 6B wrapped around armatures 5A and 5B of first magnet 2A and second magnet 2B (referring to FIGS. 1 and 2). For the three types of soils discussed above, the signal processor 10 is configured such that: i) when the work implement is working through smooth and sandy soil, a feedback signal with a relatively small magnitude is transmitted to at least one of electric coils 6A and 6B; ii) when the work implement encounters clay-like soil, an feedback signal with an increased magnitude is transmitted to at least one of electric coils 6A and 6B; and iii) when the work implement encounters an immoveable object, a feedback signal with a maximum magnitude is transmitted to at least one of electric coils 6A and 6B.

The feedback signal transmitted to at least one of electric coils 6A and 6B may create a magnetic field that interacts with the magnetic field of magnet 3 to create a repulsive, or "bucking," magnetic force. The magnitude of the bucking magnetic force may be proportional to the magnitude of the feedback signal. This bucking magnetic force acts on control lever 1 to oppose the movement of the control lever 1. Continuing with the three exemplary soil conditions, the operator feels minimum resistance in moving control lever 1 when the soil is smooth and sandy, medium resistance when the soil is clay-like, and maximum resistance when the implement encounters a hard rock. That is, this force acts as sensory feedback indicative of the work done by the machine. The operator handling the operator interface feels this feedback as a tactile sense.

While exemplary embodiments have been described referring to a specific machine, it should be understood that the disclosed invention may be used with any machines that perform work and are operable by an operator interface. Moreover, the disclosed system has utility in other applications that use an operator interface, such as, for example, video game systems. In all such systems, the tactile feedback provided to the operator will improve that operator's performance.

Other aspects, objects and advantages of this invention can be obtained from a study of the drawings, the disclosure, and appended claims.

What is claimed is:

1. An apparatus for providing feedback to an operator relative to a force applied to a system, the apparatus comprising:

a first magnet configured to receive a signal indicative of the force applied to the system and to generate a first magnetic field in response to the signal;

a second magnet disposed adjacent the first magnet and configured to generate a second magnetic field that interacts with the first magnetic field to generate a magnetic force; and an operator interface operatively engaged with one of the first magnet and the second magnet, such that the magnetic force acts on the operator interface.

2. The apparatus of claim 1, wherein the first magnet is an electromagnet and the second magnet is a permanent magnet.

3. The apparatus of claim 1, further including at least one sensing device for measuring an operational parameter of the system.

4. The apparatus of claim 3, further including a signal processor disposed between the sensing device and the first magnet, the signal processor configured to receive the operational parameter from the sensing device and to transmit the signal to the first magnet.

5. The apparatus of claim 4, wherein the magnitude of the signal varies between a first level corresponding to a minimum threshold force applied to the system and a second level corresponding to a maximum force applied to the system.

6. The apparatus of claim 4, wherein each of the first magnet and the second magnet are electromagnets and the second magnet is configured to receive a second signal from the signal processor.

7. The apparatus of claim 6, wherein the signal transmitted to the first magnet is different from the signal transmitted to the second magnet.

8. The apparatus of claim 1, wherein the first magnet and the second magnet are arranged such that the first magnetic field acts to repel the second magnetic field.

9. The apparatus of claim 1, wherein the magnetic force acts to detent the operator interface in a predetermined position.

10. The apparatus of claim 1, wherein the magnetic force acts to return the operator interface to an original position.

11. The apparatus of claim 1, wherein the operator interface is a control lever.

12. A method of controlling a hydraulic actuator having a first chamber and a second chamber, comprising:

operating an operator interface to generate a flow of pressurized fluid to at least one of the first and second chambers;

sensing a pressure representative of the pressure of the fluid in at least one of the first and second chambers;

generating a signal based on the sensed pressure; and transmitting the signal to at least one of a first and second magnets to generate a magnetic force that acts on the operator interface.

13. The method of claim 12, wherein the operator interface is moveable to generate a flow of pressurized fluid to the at least one of the first and second chambers and the magnetic force opposes the movement of the operator interface.

14. The method of claim 12, wherein the generated signal is indicative of the magnitude of the sensed pressure.

15. The method of claim 14, wherein the signal includes a magnitude component that varies with the magnitude of the sensed pressure.

16. The method of claim 12, further including sensing a second pressure representative of the pressure of the fluid in the other of the first and second chambers and generating a second signal based on the second sensed pressure.

17. A control system for a work machine, comprising:

a hydraulic actuator having a first chamber and a second chamber and operable to exert a force;

a directional control valve configured to control the rate and direction of fluid flow into the hydraulic actuator;

a moveable operator interface configured to control the operation of the control valve;

a first magnet operatively engaged with the operator interface; and a second magnet disposed adjacent to the first magnet, the first and second magnets generating a magnetic force having a magnitude related to the force exerted by the hydraulic actuator.

18. The control system of claim 17, wherein at least one of the first magnet and the second magnet is an electromagnet configured to receive a signal indicative of the force exerted by the hydraulic actuator.

19. The control system of claim 18, further including at least one pressure sensor configured to sense the pressure of fluid in at least one of the first and second chambers.

20. The control system of claim 19, further including a signal processor connected to the at least one pressure sensor and configured to generate the signal based on the sensed pressure.

21. A control system for a work machine having a hydraulically operated implement, comprising:

hydraulic actuation means for exerting a force to move the implement;

means for controlling the movement of the hydraulic actuation means;

a first magnetic means for generating a first magnetic field, the first magnetic means being operatively engaged with the controlling means; and a second magnetic means for generating a second magnetic field, the second magnetic means disposed adjacent to the first magnetic means such that the first and second magnetic fields interact to exert a magnetic force on the controlling means, wherein the magnetic force has a magnitude related to the force exerted by the hydraulic actuation means.

* * * * *